United States Patent [19]

Birkle et al.

[11] Patent Number: 4,803,811

[45] Date of Patent: Feb. 14, 1989

[54] LAPPING DEVICE FOR SURFACE ENHANCEMENT OF BULK MATERIAL

[75] Inventors: Siegfried Birkle, D8552 Hoechstadt/Aisch; Johann Gehring, D8521 Spardorf, both of Fed. Rep. of Germany

[73] Assignee: Siemens Aktiengesellschaft, Berlin and Munich, Fed. Rep. of Germany

[21] Appl. No.: 880,078

[22] Filed: Jun. 30, 1986

[30] Foreign Application Priority Data

Jul. 9, 1985 [DE] Fed. Rep. of Germany ..... 3524476

[51] Int. Cl.[4] ..... B24B 31/073

[52] U.S. Cl. ..... 51/7; 51/163.2; 51/262 R; 51/323; 51/417

[58] Field of Search ..... 51/3, 5 R, 5 F, 6, 7, 51/16, 17, 163.1, 163.2, 316, 317, 318, 319, 320, 321, 322, 323, 326, 313, 262 R, 410, 417, 422, 423, 424, 425; 204/201

[56] References Cited

U.S. PATENT DOCUMENTS

| | | | |
|---|---|---|---|
| 2,887,826 | 5/1959 | Schultz | 51/417 |
| 3,649,490 | 3/1972 | Nolan et al. | 204/201 X |
| 3,676,958 | 7/1972 | Garland | 51/163.2 |
| 3,935,680 | 2/1976 | Kobayashi . | |
| 4,000,338 | 12/1976 | Burdin | 51/163.2 X |
| 4,091,826 | 5/1978 | Bahrke . | |
| 4,427,518 | 1/1984 | de Vries et al. . | |
| 4,646,484 | 3/1987 | Brull | 51/322 X |

FOREIGN PATENT DOCUMENTS

| | | | |
|---|---|---|---|
| 871434 | 5/1971 | Canada | 51/425 |
| 0070011 | 1/1983 | European Pat. Off. . | |
| 2166843 | 3/1976 | Fed. Rep. of Germany . | |
| 2100098 | 3/1972 | France . | |
| 2318945 | 2/1977 | France . | |
| 37052 | 2/1984 | Japan | 51/7 |
| 566716 | 7/1977 | U.S.S.R. | 51/316 |
| 709342 | 1/1980 | U.S.S.R. | 51/163.1 |

OTHER PUBLICATIONS

"Gleitschleifen" *Galvanotechnik*, D-7968 Saulgau, vol. 76, No. 1 (1985), pp. 67–8.

Von Detlef Habenicht, "Hilfen zur Optimierung von Vigrationswendelförderern-Berechnungsgrundlagen" VDI-Z, vol. 123, Nr. 3 1981, Feb., pp 82–86.

*Primary Examiner*—Robert P. Olszewski

*Attorney, Agent, or Firm*—Hill, Van Santen, Steadman & Simpson

[57] ABSTRACT

A lapping device for surface enhancement of bulk material including a treatment chamber which is closed gas-tight and is charged with an inert gas, at least one vibratory conveyor being arranged in the treatment chamber and an arrangement for creating motion between a lapping abrasive liquid and the goods on the conveyor to form a surface enhancement for the goods. The arrangement for creating motion can be either abrasive nozzles for creating a jet of abrasive material directed onto the goods, the movement of the vibratory conveyor through a bath of the lapping abrasive or a combination of both. The lapping device is particularly useful for pretreatment of bulk goods which are to be electroplated.

35 Claims, 3 Drawing Sheets

LAPPING DEVICE FOR SURFACE ENHANCEMENT OF BULK MATERIAL

BACKGROUND OF THE INVENTION

The present invention is directed to a lapping device for surface enhancement of bulk material, particularly for pretreatment of the bulk material which is to subsequently receive an aluminum coating which is to be electro-deposited from an aprotic, oxygen-free and water-free, aluminum-organic electrolyte. The lapping device includes a treatment chamber in which the relative motion can be created between the bulk material and the lapping abrasive.

It should be understood that the term "lapping" is directed to a cutting process or method, wherein loose grains are distributed in a paste or a liquid as the lapping abrasive. In comparison thereto, grinding involves a cutting process or method, wherein multi-cutter tools having a geometrically defined cutter shape and the tool is formed by a plurality of grains bonded together.

Lapping devices are known, for example, from the periodical *Galvanotechnik* D-7968 Saulgau, Vol. 76, 1985, No. 1, Pages 67–68. In the lapping device which is referred to as vibratory grinding systems, the processing occurs in a moving fill of work pieces and grinding members. The processing in such lapping devices, which can be fashioned as drums, bells, vibrators, centrifugal systems and drag grinding systems, presumes a relative motion between the work piece and the grinding members which can proceed uncontrolled and both tangentially as well as normally relative to the surface of the work piece.

U.S. Pat. No. 3,935,680 discloses a lapping device for service enhancement of bulk material, wherein a compound composed of the material and abradants is introduced into a circular vibrating pipe and is compressed therein by the decreasing cross section of the vibrating pipe. The filling aperture of the vibrating pipe is closed during the operation with the closing only serving the purpose of allowing a greater quantity of the material to be placed in the pipe during the process. Since the vibrating pipe must be placed in vibration together with the material contained therein and the abradant, the structural size of the lapping device is limited. Accordingly, the output which can be achieved is correspondingly low.

The use of known lapping devices especially occurs during electro-plating processes for the general enhancement of the surface condition of the work piece with the goal of guaranteeing a well-adhering electro-deposits during a following galvanic deposition. Depending upon the initial condition of the work piece, the surface enhancement to be undertaken can include an edge rounding, smoothing, burnishing, polishing, degreasing and descaling. Further areas of application for the known lapping devices are surface enhancement for a following metallization in a vacuum, for the application of lacquer layers and for other methods of coating workpieces with usually extremely thin, protective and beautifying coatings on a less valuable substrate.

Given any suitable materials, the surface enhancement achieved in the known lapping devices are very quickly cancelled due to contact with air and atmospheric humidity. As a result of surface reactions, such as oxidation, corrosion and the like which reactions begin before the introduction of the work piece into the electrolytic bath, the precondition for well-adhering electro-deposits are at least considerably detereorated.

Aluminum deposited from aprotic, oxygen-free and waterfree, aluminum-organic electrolytes are distinguished by its ductility, low number of pores, corrosion resistance and ability to be anodized. Since, due to the reaction with atmospheric oxygen and atmospheric humidity, the access of air will cause a considerable reduction in the conductivity and in the usefulness of the electrolytes, the electro-plating must be undertaken in a treatment facility working under the exclusion of air or in a protective atmosphere. In order for the access of air to be prevented when loading and unloading, these treatment facilities, which operate under the exclusion of air, have admision and discharge locks which may be designed as gas locks, liquid locks or combined gas-liquid locks. These admission and discharge locks may be equipped with conveyor means for conducting the material to be electro-plated through the lock. Such aluminizing facility or apparatus operating under the exclusion of air and provided with admission and discharge locks for mass electroplating of bulk material is disclosed for example in the U.S. Pat. No. 4,427,518 which claims priority from the same German application as European patent No. 0,070,011.

An aluminum plating operation, which utilizes an aprotic aluminum-organic electrolyte, requires an especially careful pretreatment and surface enhancement of the material to be aluminized. First, no surface reactions which will deteriorate the adhesion of the aluminum layers dare occur between the pretreatment in a lapping device and the introduction of the material to be electro-plated into the aluminization device. Secondly, an entrainment of atmospheric oxygen, atmospheric humidity and other substance, which are harmful to the sensitive electrolyte, together with the material to be electro-plated must be prevented. For the above reasons, there has heretofore not been any success of providing materials for electro-depositing composed of material such as iron, steel, titanium and the like with adhering, galvanic aluminum coatings immediately after the pretreatment in a lapping device. An electro-deposited intermediate layer of nickel had to be previously applied in order to obtain a well adhering aluminum coating.

SUMMARY OF THE INVENTION

The object of the present invention is to create a lapping device or apparatus for surface enhancement of bulk material, wherein the general enhancement of the surface condition of the material which is achieved can be maintained until a subsequent coating operation.

To accomplish these goals, the present invention is directed to a lapping device for surface enhancement of bulk goods, particularly for pretreatment of an object which will be subsequently subjected to a process of electro-deposition of aluminum from an aprotic, oxygen-free and water-free, aluminum-organic electrolyte, this said device including a stationary treatment chamber, closable gas-tight, and being charged with inert gas, at least one vibratory conveyor being arranged in the treatment chamber for vibrating relative to the chamber and means for creating relative motion between the bulk goods one the vibratory conveyor and a lapping abrasive. The means for creating a relative motion between the bulk goods on the conveyor and the lapping abrasive can be either providing a bath of lapping abrasive in the container through which the vibratory conveyor transports the goods, subjecting the goods traveling on the conveyor to a flow of lapping abrasive from at least one lapping abrasive nozzle positioned within the chamber and directed onto a track of the conveyor or a combination of both the jet nozzle and bath.

Both solutions for creating means for moving the lapping abrasive relative to the goods, are based on a shared idea that the lapping can be undertaken with the exclusion of air in a stationary treatment chamber which is closed gas-tight and can be charged with inert gas.

A vibratory conveyor is employed for the transport of the bulk goods through the treatment chamber. The vibratory conveyor can then transport the bulk goods through the lapping abrasive bath contained in the treatment chamber and the relative motion between the bulk goods and the lapping abrasive required for the lapping process is generated in a fashion similar to that in known lapping devices utilizing vibrators. In accordance with the other solution, the lapping, however, can also be undertaken in a manner of a jet lapping, wherein the jets emerging from the lapping abrasive nozzles are directed against the bulk goods which are moved passed on the conveyor track of the vibratory conveyor. Goods processed under air exclusion by immersion lapping or jet lapping can then, without coming into contact with air, be introduced into a following coating apparatus with the introduction thereto either being directly or via an admission lock. In this way, the reactions, such as oxidation, corrosion and the like, which reactions would deteriorate the surface enhancement, can be suppressed up to the following coating event. The lapping device of the invention are therefore particularly suited as well as for pretreatment for electro-deposition of aluminum from aprotic, oxygen-free and water-free, aluminum-organic electrolyte. Therefore, the electro-deposition of an intermediate layer of nickel, which was heretofore required when aluminizing bulk goods of iron, steel, titanium and the like, can be eliminated since the lapping can be unproblematically undertaken under an inert gas atmosphere with the assistance of a non-aqueous, aprotic lapping abrasives.

The vibratory conveyor employed in the lapping device of the invention are a matter of conveyor means which conveys bulk goods in a horizontal and/or inclined direction under exploitation of the force of gravity on a definite conveying path. Obliquely acting vibrators or obliquely placed connecting rods generally serve as drive means which place the conveyor track into vibration so that the goods usually execute microprojectile motion and are transported in a conveying direction while gaining in height under the given conditions.

The use of such a vibratory conveyor in the lapping device of the invention enables an extremely gentle conveying of the goods, wherein a jamming of the conveyed goods need not be feared. In view of the lapping taking place under the exclusion of air, the use of the vibratory conveyor as a conveying means has the additional advantage that no drive shafts need to be conducted out of the treatment chamber and thus, need to be sealed. The sealing of rotating parts, which are necessary when utilizing a conveyor means with conveying belts, are not necessary and since such sealings are problematical given the characteristics and high demands caused by a pretreatment with an aprotic lapping abrasive, the provision of not requiring these seals is desirable.

A vibratory conveyor used in the device of the invention preferably comprises an ascending conveyor track. In view of an optimum low space requirement, given relative great lengths of the conveyor track and thus, of the processing path, it is then especially advantageous when the conveyor track is helically conducted in an upward or vertical path. What is referred to as a vibrational helix conveyor is thus, employed for conveying the goods through the treatment chamber. The use of such a conveyor has already been proven in devices for supplying and classifying small parts in manipulation technology (see VDI-Z123, 1981, No. 3, February 1, pages 82–86). In all cases, the conveyor track of the vibratory conveyor is preferably fashioned as a vibrating conveyor which guarantees a reliable guidance of the goods to be transported through the treatment chamber with a low cost or outlay.

Given immersion lapping in a lapping abrasive bath, the conveying track of the vibratory conveyor is preferably conducted out above the level of the lapping abrasive bath. Lapping abrasives still adhering to the goods above the bath level are then hurrled off by the vibrations and this removal is further promoted when the conveying track is provided with perforations at least in the region conducted out of or above the level of the lapping abrasive bath.

An entrainment of the lapping abrasives out of the treatment chamber can be entirely excluded when spray means for spraying a liquid cleaning agent is arranged above the level of the lapping abrasive bath. A solvent contained in the lapping abrasive bath is preferably used in the spraying means as a cleaning agent. In order to keep the composition of the lapping abrasive bath as consistant as possible, the solvent is acquired from the lapping abrasive bath and is acquired either with the assistance of at least one filter or with the assistance of a distilling arrangement or device.

The feed to the bulk goods to the lapping device can be realized in an especially simple way when as viewed in the conveying direction, the vibratory conveyor is proceded by a gravity conveyor. The same advantage also occurs when the vibratory conveyor as seen in the conveying direction is followed by a gravity conveyor. In both cases, it is then especially favorable when the gravity conveyor is formed by a downpipe. Such downpipes can also be easily connected to the corresponding admission and/or discharge locks in view of the air exclusion of the treatment chamber. In a discharge lock, the downpipe can then likewise already be employed as a downwardly leading leg of a U-shaped liquid lock. Moreover, given the employment of admission or discharge locks for the introduction or respectively, discharge of the bulk goods, vibratory conveyors can likewise be employed. The vibratory conveyors would guarantee a gentle treatment of the goods and not raise any problems in view of the sealing of the lock chambers.

In accordance with the further and particular preferred development of the invention, the bulk goods are returnable into the starting area of the vibratory conveyor. This returning is by a return means optionally connectable to the end of the vibratory conveyor. In this case, the lapping can be undertaken in two or more passes so that the lapping duration can be arbitrarily increased without lengthening the conveyor track. Only after the desired surface condition has been achieved are the goods discharged from the apparatus. The changeover between circulation and discharge can be accomplished in a particular simple way when the return means is connectable to the end of the vibratory conveyor via a switch. When the return means is fashioned as a gravity conveyor, then additional conveying means for the return can be ommitted. The gravity conveyor is then again expediently formed by a downpipe which further improves the mixing of the goods given moreover a gentle treatment thereof. The additional intimate mixing of the goods which provides a particularly uniform surface treatment from all sides can also be achieved in that the conveyor track of the vibratory conveyor as seen in the conveying direction comprises at least one downwardly leading step or stage.

The ascending conveyor track of the vibratory conveyor is preferably secured to a centrally arranged carrying column. In addition to the transmission of the vibrations, the carrying column then also fillfuls the job of a space saving support structure for the conveyor track.

The vibrations expectation is effected with a low outlay in that the carrying column is arranged on a vibrator. Moreover it is also possible that the carrying column is arranged on a support plate seated in a vibratable fashion in the treatment chamber and carries a vibrator. As a result of incorporating the overall vibrational excitation in the treatment chamber, the problems of sealing the vibratory drive means conducted in from the outside of the tank are eliminated.

DESCRIPTION OF THE PREFERRED EMBODIMENTS

Figure 1:
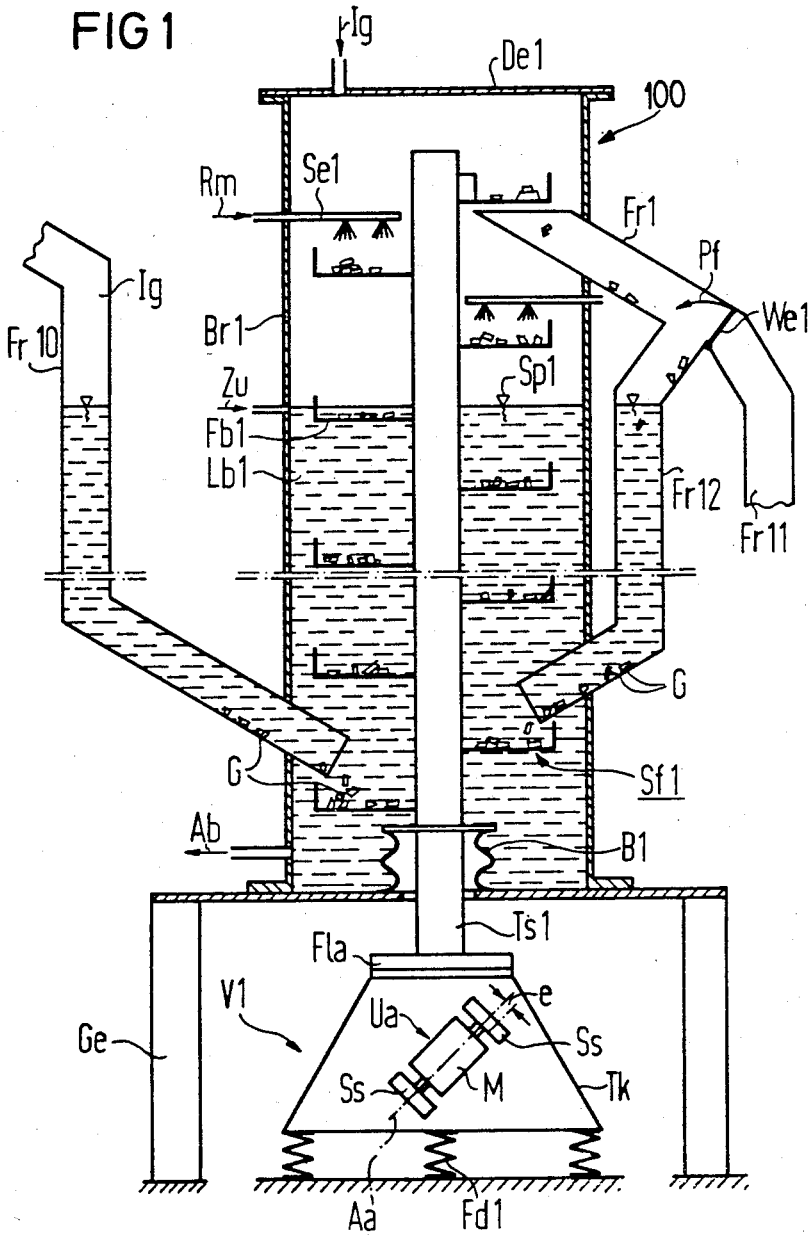
FIG. 1 is a vertical cross sectional view with portions in elevation for purposes of illustration of one embodiment of a lapping device in accordance with the present invention.

The principles of the present invention are particularly useful when incorporated in a lapping device generally indicated at 100 in FIG. 1. A lapping device 100 is a tower-shaped lapping device for surface enhancement of bulk goods G which are, for example, nuts, bolts, screws, spacer bushings and the like. The treatment of the bulk goods G serves as a pretreatment for the following electro-deposition of an aluminum coating from an aprotic, oxygen-free and water-free, aluminum-organic electrolyte.

The lapping device 100 has a circular cylindrical treatment chamber Br1, which is arranged on a frame Ge and is closed gas-tight with the assistance of an upper cover De1. A lapping abrasive bath Lb1, which involves lapping grains such as, for example, silicon carbide, aluminum oxide abrasives and the like suspended in an aprotic solution such as, for example, toluol is situated in the chamber Br1 and has an upper level Sp1. The region of the treatment chamber Br1 located above the level Sp1 is charged with an inert gas such as, for example, nitrogen and this gas is fed into an inlet illustrated as being in the cover De1 with the direction of charging being indicated by an arrow Ig.

The goods G, which are to be processed, are introduced into the lower region of the treatment chamber Br1 from above by use of an admission lock (not shown in greater detail) and a downpipe Fr10, wherein the downpipe is filled with the lapping abrasive bath Lb1 up to the height of the level Sp1 and is charged with an inert gas Ig thereabove. The goods G introduced via the downpipe Fr10 then fall onto a lower end of a conveyor track Fb1 of a vibratory conveyor, generally indicated at Sf1, which conveyor is arranged in the treatment chamber Br1. The conveying track Fb1 is fashioned as a helically ascending vibrating conveyor. The goods are transported up from above the level Sp1 by the conveyor track Fb1 and then fall onto a funnelshaped, upper end of a downpipe Fr1 which lead out of the treatment chamber Br1. This downpipe Fr1 branches into a downpipe Fr11 and into a downpipe Fr12 in the manner of a bifurcated pipe. At this branching, a switch We1 is arranged and the goods can then be returned into the lower most turn of the helical conveyor track Fb1 by the downpipe Fr12 which re-enters into the treatment chamber Br1. When the switch We1, which is constructed as a pivotal flap, is changed over in the direction as indicated by the arrow Pf, the goods will then proceed via the downpipe Fr11 into an aluminizing facility functioning under air exclusion which facility is arranged downstream of the device 100. The downpipe Fr11 may be connected directly to the aluminizing facility or apparatus or be connected through a lock.

The conveyor track Fb1, which helically ascends inside the treatment chamber Br1, is fastened to a centrally arranged carrying column Ts1, whose lower end is fastened on a vibrator V1 centrally arranged within the frame Ge. The passage of the carrying column Ts1 through the floor of the treatment chamber Br1 is sealed by an elastic and wear-resistant bellows B1, which is connected at one end to a plate on the carrying column Ts1 and on the other end to the floor of the treatment chamber Br1. As a result of the vibrator V1, the conveyor track Fb1 is excited via the carrying column Ts1 to vibrate in a roughly helical motion relative to the chamber Br1 and the bath Lb1. As a consequence of this oblique motion and the accelerations and speeds which occur, the goods G lying on the helically ascending conveyor track Fb1 have an oblique projectile motion imposed upon them so that the goods are upwardly transported to gain in height while gaining in the conveying direction. Since the distance of the projectile motion and the height of the projectile motion are extremely slight, this type of conveying involves a microprojectile conveying which guarantees an extremely gentle treatment of the goods G.

In the illustrated embodiment, the carrying column Ts1 is rigidly connected via a flange Fla to a carrier member Tk of the vibrator V1. This carrier member Tk is conically expanding in the downward direction and is vibrationally seated on the foundation by a plurality of springs Fd1. An unbalanced drive Ua is arranged within the conical support member Tk. The unbalanced drive has a motor M with a shaft Aa on which flywheels Ss with adjustable eccentricities e are arranged. The drive shaft Aa is inclined at an angle, for example, of 45° relative to the horizontal so that the unbalance of the disk flywheels Ss generate the aforesaid vibrations with a roughly helical motion.

The goods G are transported through the lapping abrasive bath Lb1 via the conveyor track Fb1 and the goods will have their surface quality enhanced by the relative motion between the goods G and the lapping grains contained in the bath of lapping abrasive. The lapping device is operated in circulation when the switch We is in the position as illustrated and until the desired surface enhancement has been established. After this, the goods are conveyed above the level Sp1 of the lapping abrasive bath Lb1 and are freed of the adhering lapping abrasives with the assistance of spray means Se1 arranged in the treatment chamber Br1. After being sprayed with the spray means, the goods are then introduced into the downpipe Fr1, through the switch We1, which has been moved to deflect the goods into the downpipe Fr11, to proceed to the next station such as the aluminization apparatus. The spray means Se1 will spray a liquid cleaning agent Rm, which is acquired from the lapping abrasive bath Lb1 as set forth in greater detail in the discussion with reference to FIGS. 4 and 5.

Since the entire lapping procedure occurs under an inert gas atmosphere and under entirely aprotic conditions, the goods G, likewise, do not come into contact with air during introduction into the following aluminization apparatus. The surface enhancement, which was achieved in the lapping device, is maintained until the deposition of aluminum. For this reason, goods composed even of iron, steel, titanium and the like can be immediately electro-coated with aluminum without the application of an intermediate layer of nickel which is heretofore been required.

In view of the abrasive properties of the lapping grain contained in the lapping abrasive bath Lb1, the walls and floor of the treatment chamber Br1, the conveying track Fb1 and the carrying column Ts1 should be composed of abrasion-resistant material at least in those regions coming into contact with the bath. If not made of an abrasion-resistant material, these parts should be provided with an abrasion-resistant coating such as, for example, hard metal.

The lapping abrasive bath Lb1 accommodated in the treatment chamber Br1 must be replenished from time to time or must be freed of abradants in a continuous process and must be provided with new lapping grains. The feed and removal of the liquid lapping abrasive is indicated in FIG. 1 by an inlet Zu and an outlet Ab.

Figure 2:
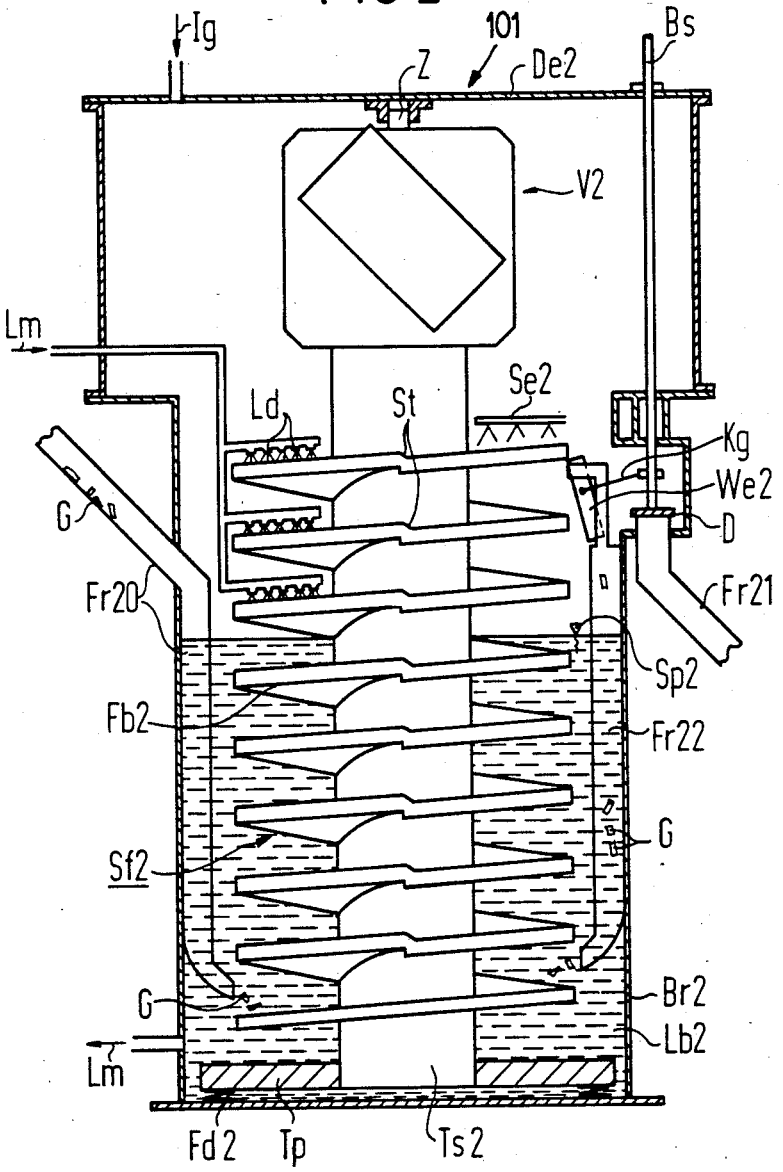
FIG. 2 is a vertical cross sectional view with portions in elevation for purposes of illustration of a second embodiment of a lapping device in accordance with the present invention.

A second embodiment of a tower-shaped lapping device for surface treatment of bulk goods G is generally indicated at 101 in FIG. 2. The device 101 has a circular cylindrical treatment chamber Br2 which is illustrated as immediately arranged on the floor and is closed by a gas-tight upper cover De2. An aprotic lapping abrasive bath Lb2 is situated in the chamber Br2 and has a liquid level Sp2. The region of the chamber Br2 above the liquid level Sp2 is charged with an inert gas, which is fed through an inlet in the cover De2 as indicated by the arrow Ig.

The goods G to be treated are introduced into the treatment chamber Br2 by a downpipe Fr20 and then fall onto the lower end of a conveyor track Fb2 of a vibratory conveyor generally indicated as Sf2 and arranged in the treatment chamber Br2. The conveyor track Fb2 is a helically ascending track which is fashioned as a vibrating conveyor. The goods are transported up through the lapping abrasive Lb2 by the track Fb2 and then fall onto a switch We2 which is constructed as a short channel. On the upward path, the goods G pass a plurality of downwardly leading steps St on the conveyor track Fb2. These steps have a height which is dimensioned so that the goods G turn while falling over the step and this turning and falling improves the mixing of the goods. When the switch We2 is in the position illustrated, the goods proceed into a downpipe Fr22 which forms return means which returns the goods G to the lower most turn of the conveyor track Fb2. Given the illustrated position of the switch We2, the goods are thus, conveyed in a circulation through the lapping abrasive bath Lb2 more than one time. After the desired surface enhancement has been achieved, the goods are cleaned with the assistance of a spray means Se2 and are discharged via a downpipe Fr21 after the switch We2 has been pivoted to a new position. The downpipe Fr21 has an upper opening which is closed by a cover D. The opening and closing of the cover D can be pneumatically or hydraulically undertaken via an actuation rod Bs which extends to the outside of the chamber Br2. The switch We2 is mounted to pivot between two positions and is coupled by a coupling element Kg to the actuation rod Bs so that during the stroke to remove the cover D from the opening of the downpipe Fr21, the channel forming the switch We2 will be pivoted to a position to discharge the goods into the downpipe Fr21.

The helical conveyor track Fb2 is fashioned on a centrally arranged carrying column Ts2 whose lower end is vibrationally seated on the floor of the treatment chamber Br2 by a carrying plate Tp and a plurality of springs Fd2 which allows the columns Ts2 and track Fb2 to vibrate relative to the chamber Br2 and bath Lb2. An upper end of the column Ts2 carries a vibrator V2 in that region lying above the liquid level Sp2 of the lapping abrasive bath Lb2. The vibrator V2 (which is not shown in greater detail with respect to its function) can have a structure similar to the vibrator V1 of the device of FIG. 1. The vibrator V2 is rotatably connected to the cover De2 by a bearing Z, which helps maintain the central positioning of the vibrator and shaft Ts2. In addition, the bearing Z allows a slight degree of raising and lowering of the shaft as desired.

The device 101 also has a modification in which the lapping in the treatment chamber Br2 is undertaken solely by means of jet lapping or by means of a combination of jet lapping and the immersion lapping. For this purpose, a plurality of lapping abrasive nozzles Ld are directed towards the conveyor track Fb2 and these lapping nozzles are supplied with a pressurized lapping abrasive Lm. The lapping abrasive nozzles Ld can be arranged over the full length of the conveyor path in a helical course parallel to the conveying track Fb2 so that the lapping abrasive bath Lb then only serves as a sump for the lapping abrasive whose feed and removal is indicated by arrows Lm. For the remainder, this jet lapping device, which is disclosed as a modification, function like other such devices, however the lapping abrasive Lm, however, is not conveyed to the lapping abrasive nozzles Ld with the assistance of compressed air but, rather, with the assistance of pressurized inert gas such as, for example, nitrogen.

Figure 3:
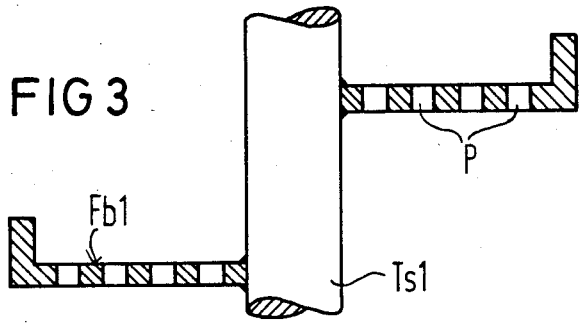
FIG. 3 is an enlarged cross sectional view of a conveyor track utilized in a lapping device of FIG. 1.

The conveyor track Fb1 of the device 100 is illustrated in greater detail in FIG. 3 as being a perforated member having perforations P and secured to the column Ts1. In that region leading from the lapping abrasive bath Lb1 of the device 100 of FIG. 1, the perforations allow improved access of the lapping abrasive to the goods G, wherein the perforations in the regions above the upper surface of the bath promote the spin-off of the lapping abrasive still adhering to the goods and the cleaning of the goods G with the assistance of the spray means Se1.

Figure 4:
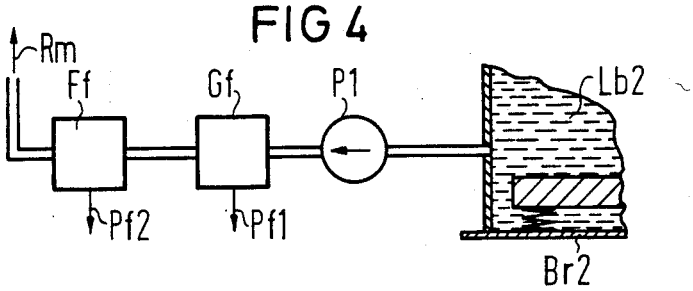
FIG. 4 is a schematic view of a first embodiment of an arrangment for acquiring a cleaning agent from the lapping abrasive bath in accordance with the present invention.

As mentioned hereinabove, the spray means obtains a cleaning agent from the lapping abrasive bath. One arrangement is illustrated in FIG. 4 for removing the cleaning agent Rm from the lapping bath Lb2 in the device 101 of FIG. 2. The cleaning agent Rm is obtained in the following manner. The lapping abrasive contained in the bath Lb2 is withdrawn by a pump P1 and then is freed of solid components in a coarse filter Gf and then is conducted to a fine filter Ff to remove the fine solids. The remaining liquid is then supplied as the aprotic solvent Rm to the spray devices such as Se2. The arrows Pf1 and Pf2 indicate that the solid components, which are removed in the course filter Gf and the fine filter Ff, respectively, are removed from the respective filters. The components, which are the lapping grains and abradant, can either be subjected to a processing or can be directly returned to the treatment chamber Br2.

Figure 5:
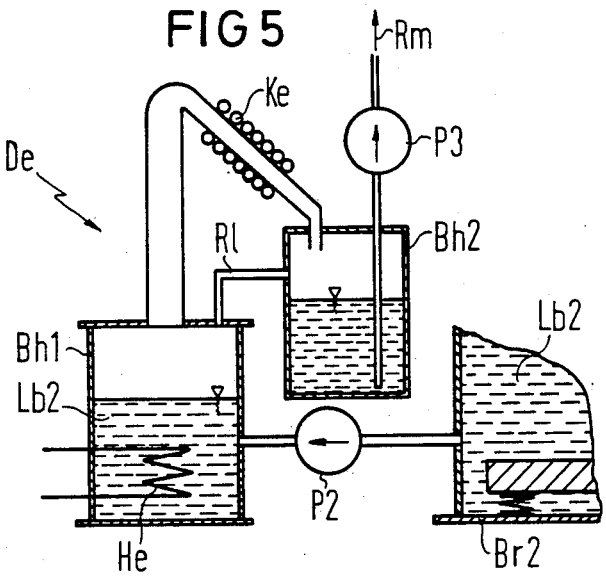
FIG. 5 is a second embodiment of a means for acquiring a cleaning agent from the lapping abrasive bath.

Another arrangement for removing the solvent Rm from the abrasive bath is illustrated in FIG. 5. In this second arrangement, the liquid lapping abrasive contained in the lapping abrasive bath Lb2 is withdrawn with the assistance of a pump P2 and is supplied to a distilling means generally indicated at De. The distilling means De has a first container Bh1 in which the lapping abrasive bath Lb2 is heated with the assistance of a heating means He so that the aprotic solvent contained therein will evaporate. The evaported solvent is then condensed with the assistance of a cooling means Ke and is collected in a second container Bh2. From this second container Bh2, the condensed solvent is supplied by a pump P3 as a liquid cleaning agent Rm to the spray means Se2. The second container Bh2 is connected to the first container Bh1 by a return pipe R1 which serves as an overflow.

Although various minor modifications may be suggested by those versed in the art, it should be understood that we wish to embody within the scope of the patent granted hereon, all such modifications as reasonably and properly come within the scope of our contribution to the art.

We claim:

1. A lapping device for surface enhancement of bulk goods as a pretreatment for the electrodeposition of aluminum from an aprotic, oxygen-free and water-free, aluminum-organic electrolyte, said device comprising: a stationary, closable gas-tight treatment chamber, means for charging the treatment chamber with an inert gas, a lapping abrasive bath being contained in the treatment chamber, at least one vibratory conveyor having a conveyor track being arranged in the treatment chamber to carry said goods through said bath, means for vibrating said conveyor track relative to said chamber, means for feeding said goods into and out of said chamber without loss of said inert gas to permit continuous treatment of said goods, and the lapping abrasive bath in the treatment chamber providing lapping of the goods as they are transported by the vibratory conveyor passing through the bath.

2. A lapping device according to claim 1, wherein the vibratory conveyor comprises an ascending conveyor track.

3. A lapping device according to claim 2, wherein the ascending conveyor track is a helically ascending track.

4. A lapping device as claimed in claim 1, wherein said means for feeding includes a feed passage for feeding said goods to said conveyor track, said feed passage having an inlet extending to below a fluid level of said lapping abrasive bath so that said goods may be fed to said conveyor track through said inlet of said feed passing without loss of said inert gas.

5. A lapping device according to claim 1, wherein the conveyor track of the vibratory conveyor has a portion extending above the level of the lapping abrasive bath.

6. A lapping device according to claim 5, wherein the conveyor track is provided with perforations at least in the portion of the conveyor track above the level of the lapping abrasive bath.

7. A lapping device according to claim 5, which includes spray means for spraying a liquid cleaning agent being arranged above the level of the bath of lapping abrasive.

8. A lapping device according to claim 7, which includes means for removing a solvent from the bath of lapping abrasives and supplying the removed solvent to the spray means as a cleaning agent.

9. A lapping device according to claim 8, wherein the means for removing solvent comprises at least one filter.

10. A lapping device according to claim 8, wherein the means for removing a solvent comprises means for distilling the solvent from the bath of lapping abrasive.

11. A lapping device according to claim 1, which includes inlet means having a gravity conveyor for discharging goods onto the beginning of the vibratory conveyor.

12. A lapping device according to claim 1, wherein said device includes a gravity conveyor for receiving the output from the vibratory conveyor.

13. A lapping device according to claim 1, which has at least one gravity conveyor coacting with the vibratory conveyor being formed by a downpipe.

14. A lapping device according to claim 1, which includes return means for selectively returning the output from the vibratory conveyor to the beginning of the vibratory conveyor for a second pass.

15. A lapping device according to claim 14, which includes switch means for selectively connecting the output of the vibratory conveyor to the return means.

16. A lapping device according to claim 15, wherein the return means is fashioned as a gravity conveyor.

17. A lapping device according to claim 16, wherein the gravity conveyor is formed by a downpipe.

18. A lapping device according to claim 1, wherein the conveyor track of the vibratory conveyor has at least one descending step as seen in the conveying direction.

19. A lapping device according to claim 1, wherein the conveyor track is a helically ascending track fastened to a centrally arranged carrying column.

20. A lapping device according to claim 19, wherein the carrying column is arranged on a vibrator.

21. A lapping device according to claim 19, wherein the carrying column is on a carrier plate vibrationally seated in the treatment chamber and a vibrator is mounted on said column.

22. A lapping device for surface enhancement of bulk material as a pretreatment for the electrodeposition of aluminum from an aprotic, oxygen-free and water-free, aluminum-organic electrolyte, said device comprising: a stationary gas-tight closable treatment chamber, means for charging the interior of the treatment chamber with an inert gas, at least one vibratory conveyor having a conveyor track being arranged in said treatment chamber, means for vibrating said conveyor track relative to the treatment chamber, at least one nozzle directed at the conveyor track, means for supplying lapping abrasive in a liquid under pressure to said nozzle, and means for feeding and discharging said bulk material into and out of said treatment chamber without loss of said inert gas.

23. A lapping device according to claim 22, wherein the conveyor track is a helically ascending track.

24. A lapping device according to claim 23, wherein the chamber has a bath of retained lapping abrasives, and the conveyor track extends above a level of the bath of lapping abrasive retained in the treatment chamber and has perforations at least in the region extending above said level.

25. A lapping device according to claim 24, which includes spray means for spraying a cleaning liquid agent being arranged above the level of the bath of lapping abrasive in said chamber.

26. A lapping device according to claim 25, which includes means for obtaining a solvent from the bath of lapping abrasive.

27. A lapping device according to claim 26, wherein said means for obtaining includes at least one filter.

28. A lapping device according to claim 26, wherein the means for obtaining includes means for distilling the solvent from said bath of lapping abrasive.

29. A lapping device according to claim 23, which includes return means for selectively returning goods from the end of the conveyor track to a starting region of said conveyor track.

30. A lapping device according to claim 29, wherein said return means includes a switch for selectively directing the goods from the end of the conveyor track into the return means and into a discharge opening for said device.

31. A lapping device according to claim 29, wherein said return means includes a gravity conveyor formed by a downpipe.

32. A lapping device according to claim 22, wherein the conveyor track includes at least one descending step in the conveying direction.

33. A lapping device according to claim 22, wherein the vibratory conveyor includes a helically ascending conveyor track secured to a centrally arranged carrying column.

34. A lapping device according to claim 33, wherein said carrying column is connected to a vibrator.

35. A lapping device for surface enhancement of the bulk goods particularly for pretreatment for the electrodeposition of aluminum from aprotic, oxygen-free and water-free, aluminum-organic electrolyte, said device comprising a stationary, closable gas-tight treatment chamber, means for charging the treatment chamber with an inert gas, at least one vibratory conveyor having a conveyor track being arranged in the treatment chamber, a lapping abrasive bath being contained in the treatment chamber with the goods being transported by the vibratory conveyor passing through the bath, and at least one lapping abrasive nozzle being directed onto the conveyor track of the vibratory conveyor in said treatment chamber above the level of the bath of the lapping abrasive, said abrasive nozzles having means supplying a lapping abrasive under pressure thereto.

* * * * *